US007088312B2

(12) United States Patent
Ishizuka et al.

(10) Patent No.: US 7,088,312 B2
(45) Date of Patent: Aug. 8, 2006

(54) PLASMA DISPLAY AND DRIVING METHOD OF THE SAME

(75) Inventors: Mitsuhiro Ishizuka, Tokyo (JP); Eiichi Urushibata, Tokyo (JP); Tadashi Nakamura, Tokyo (JP); Hiroshi Shirasawa, Tokyo (JP); Takatoshi Shoji, Tokyo (JP)

(73) Assignee: Pioneer Corporation, Tokyo (JP)

( * ) Notice: Subject to any disclaimer, the term of this patent is extended or adjusted under 35 U.S.C. 154(b) by 340 days.

(21) Appl. No.: 10/054,863

(22) Filed: Jan. 25, 2002

(65) Prior Publication Data

US 2002/0118312 A1 Aug. 29, 2002

(30) Foreign Application Priority Data

Feb. 27, 2001 (JP) ..... 2001-052758

(51) Int. Cl.
*G09G 3/28* (2006.01)

(52) U.S. Cl. ..... 345/60; 345/37; 345/211; 315/169.4

(58) Field of Classification Search ..... 345/60–69, 345/211, 212, 89, 690, 72, 37; 315/169.1–169.4; 713/300, 310; 348/725
See application file for complete search history.

(56) References Cited

U.S. PATENT DOCUMENTS 4,349,819 A * 9/1982 Terakawa ..... 345/211
5,583,527 A * 12/1996 Fujisaki et al. ..... 345/55
5,754,154 A * 5/1998 Katakura et al. ..... 345/97
5,956,014 A * 9/1999 Kuriyama et al. ..... 345/690
6,288,495 B1 * 9/2001 Yashiro ..... 315/169.1
6,326,938 B1 * 12/2001 Ishida et al. ..... 345/63
6,522,314 B1 * 2/2003 Tomio et al. ..... 345/68
6,724,356 B1 * 4/2004 Kojima et al. ..... 345/60

FOREIGN PATENT DOCUMENTS

| | | |
|---|---|---|
| JP | H07-152341 | 6/1995 |
| JP | 2853537 | 11/1998 |
| JP | 11-38930 | 2/1999 |
| KR | 1998-10983 A | 4/1998 |

OTHER PUBLICATIONS

Awamoto et al, Dec. 2, 1999, Japan Pub. No. 11-038930.*

* cited by examiner

*Primary Examiner*—Regina Liang
*Assistant Examiner*—Jennifer T. Nguyen
(74) *Attorney, Agent, or Firm*—Sughrue Mion, PLLC

(57) ABSTRACT

A plasma display is provided with a plasma display panel, data drivers which apply data pulse to data electrodes of the plasma display panel, a control circuit which t controls an operation of the data drivers based on a video signal, and a protection signal output circuit. The protection signal output circuit outputs a protection signal to the control circuit when sum of currents supplied from the data drivers to the data electrodes within a time equal to one sub-field or more to less than one frame exceeds a previously set first specified current value. The protection signal restrains the operation of the data drivers.

12 Claims, 14 Drawing Sheets

FIG. 13

| RATIO | ONE-DOT STAGGER | 0.090909 | 0.090909 | 0.090909 | 0.090909 | 0.090909 |
|---|---|---|---|---|---|---|
| | ACTUAL VIDEO | 0.175 | 0.175 | 0.15 | 0.1111 | 0.09722 |
| SUB-FIELD | | SF1 | SF2 | SF3 | SF4 | SF5 |
| PROTECTIVE POERATION | 0 | P | P | P | P | P |
| | 1 | I | P | P | P | P |
| | 2 | I | I | P | P | P |
| | 3 | I | I | I | P | P |
| | 4 | C | I | I | I | P |
| | 5 | C | C | I | I | I |
| | 6 | C | C | C | I | I |
| | 7 | C | C | C | C | I |
| | 8 | C | C | C | C | C |
| | 9 | C | C | C | C | C |

| RATIO | ONE-DOT STAGGER | 0.090909 | 0.090909 | 0.090909 | 0.090909 | 0.090909 | 0.090909 |
|---|---|---|---|---|---|---|---|
| | ACTUAL VIDEO | 0.08333 | 0.06944 | 0.05555 | 0.041667 | 0.02777 | 0.013889 |
| SUB-FIELD | | SF6 | SF7 | SF8 | SF9 | SF10 | SF11 |
| PROTECTIVE POERATION | 0 | P | P | P | P | P | P |
| | 1 | P | P | P | P | P | P |
| | 2 | P | P | P | P | P | P |
| | 3 | P | P | P | P | P | P |
| | 4 | P | P | P | P | P | P |
| | 5 | P | P | P | P | P | P |
| | 6 | I | P | P | P | P | P |
| | 7 | I | I | P | P | P | P |
| | 8 | I | I | I | P | P | P |
| | 9 | I | I | I | I | I | I |

PLASMA DISPLAY AND DRIVING METHOD OF THE SAME

BACKGROUND OF THE INVENTION

1. Field of the Invention

The present invention relates to a plasma display utilized for a flat television, an information display and the like, and a driving method thereof. Particularly, the present invention relates to a plasma display and a driving method thereof intended to protect a built-in circuit and a driving method thereof.

2. Description of the Related Art

A plasma display panel generally presents the following characteristics. A plasma display panel has a thin structure. It hardly generates flickers. It provides a high display contrast. It may be produced as a relatively large screen. It provides a high response speed. It is self-light-emitting type, and may provide multiple color light emission by means of the phosphor. Therefore, it has been widely utilized in the field of computer-related display, the field of color image display, and the like.

The plasma display is classified into an AC type in which electrodes are coated by dielectric and operated indirectly under the state of alternating-current discharge, and a DC type in which electrodes are exposed to discharge space and operated directly under the state of direct-current discharge. The AC type plasma display is classified into a memory operation type in which memory of display cell is utilized as a driving method, and a refresh operation type that does not utilize the memory. Luminance of plasma display is proportional to the number of discharge. The refresh type is mainly used for the plasma display of a small display capacity since the luminance reduces as the display capacity becomes larger.

FIG. 1 is a perspective view exemplifying a display cell configuration of the AC type plasma display.

The display cell is provided with two insulated substrates 101 and 102 made up of glass. The insulated substrate 101 is a rear substrate, and the insulated substrate 102 is a front substrate.

Transparent scanning electrodes 103 and transparent common electrodes 104 are provided on a side of the insulated substrate 102 facing the insulated substrate 101. The scanning electrodes 103 and the common electrodes 104 extend in the horizontal direction (transverse direction) of a panel. Further, trace electrodes 105 and 106 are arranged so as to superpose the scanning electrodes 103 and the common electrodes 104 respectively. The trace electrodes 105 and 106 are made of metal, for example, and provided to reduce electrode resistance between each electrode and an external drive unit. Moreover, a dielectric layer 112 that covers the scanning electrodes 103 and the common electrodes 104, and a protective layer 114 made up of magnesium oxide or the like that protects the dielectric layer 112 from discharge are provided.

Data electrodes 107, which are orthogonal to the scanning electrodes 103 and the common electrodes 104, are provided on a side of the insulated substrate 101 facing the insulated substrate 102. Accordingly, the data electrodes 107 extend in perpendicular direction (longitudinal direction) of the panel. Further, partition walls 109 that separate the display cell in the horizontal direction are provided. Further, a dielectric layer 113 covering the data electrodes 107 is provided, and phosphor layer 111, which transforms ultraviolet ray generated due to discharge of discharge gas into visible light 110, is formed on a side of each of the partition walls 109 and a surface of the dielectric layer 113. Then, the partition walls 109 secure discharge gas space 108 in the space between the insulated substrates 101 and 102, and the discharge gas such as Helium, Neon, Xenon or the like, or mixed gas composed of these gases is filled into the discharge gas space 108.

FIG. 2 is a block diagram showing a conventional AC type plasma display. N pieces (n: natural number) of the scanning electrodes 3-1 to **3-*n* (103) and n pieces of the common electrodes 4-1 to 4-*n* (104), both of which extend in row direction, are provided alternately with a predetermined space, and m pieces (m: natural number) of the data electrodes 10-1 to 10-*n* (107) extending in column direction so as to be orthogonal to the scanning electrodes 3-1 to 3-*n* (103) and the common electrodes 4-1 to 4-*n* (104) are provided to the PDP 1. Therefore, (n×m) pieces of display cells are provided to the PDP 1**.

The conventional plasma display is provided with a power source for driving 21, a controller 22, a scanning driver 23, a scanning pulse driver 24, a sustaining driver 25, and a data driver 26, as driving circuits for the PDP 1.

The power source for driving 21 generates a logic voltage Vdd of 5V, a data voltage Vd of about 70V, and a sustaining voltage Vs of about 170V, and also generates a priming voltage Vp of about 400V, a scanning base voltage Vbw of about 100V, and a bias voltage Vsw of about 180V based on the sustaining voltage Vs. The logic voltage Vdd is supplied to the controller 22. The data voltage Vd is supplied to the data driver 26. The sustaining voltage Vs is supplied to the scanning driver 23 and the sustaining driver 25. The priming voltage Vp and the scanning base voltage Vbw are supplied to the scanning driver 23. The bias voltage Vsw is supplied to the sustaining driver 25.

The controller 22 is a circuit that generates scanning driver control signals (Sscd 1 to Sscd 6), scanning pulse driver control signals (Sspd 11 to Sspd **1*n*, and Sspd 21 to Sspd 2*n*), sustaining driver control signals (Ssud 1 to Ssud 3); and data driver control signals (Sdd 11 to Sdd 1*m*, and Sdd 21 to Sdd 2*m*), based on a video signal Sv supplied from the outside. The scanning driver control signals Sscd 1 to Sscd 6 are supplied to the scanning driver 23. The scanning pulse driver control signals Sspd 11 to Sspd 1*n* and Sspd 21 to Sspd 2*n* are supplied to the scanning pulse driver 24. The sustaining driver control signals Ssud 1 to Ssud 3 are supplied to the sustaining driver 25. The data driver control signals Sdd 11 to Sdd 1*m* and Sdd 21 to Sdd 2*m* are supplied to the data driver 26**.

The scanning driver 23 is composed of six switches 23-1 to 23-6, for example, as shown in FIG. 3. The priming voltage Vp is applied to one end of the switch 23-1, and the other end of the switch 23-1 is connected to a positive line 27. The sustaining voltage Vs is applied to one end of the switch 23-2, and the other end of the switch 23-2 is connected to the positive line 27. One end of the switch 23-3 is grounded, and the other end of the switch 23-3 is connected to a negative line 28. The scanning base voltage Vbw is applied to one end of the switch 23-4, and the other end of the switch 23-4 is connected to the negative line 28. One end of the switch 23-5 is grounded, and the other end of the switch 23-5 is connected to the positive line 27. One end of the switch 23-6 is grounded, and the other end is connected to the negative line 28. The switches 23-1 to 23-6 are turned ON/OFF based on the scanning driver control signals Sscd 1 to Sscd 6, respectively, and a voltage of a predetermined waveform is supplied to the scanning pulse driver 24 via the positive line 27 and the negative line 28.

The scanning pulse driver 24 is composed of n pieces of switches 24-11 to **24-1*n*, n pieces of switches 24-21** to 24-2*n*, n pieces of diodes 24-31 to 24-3*n*, and n pieces of diodes 24-41 to 24-4*n*, for example, as shown in FIG. 3. The diodes 24-31 to 24-3*n* are connected in parallel to both ends of the switches 24-11 to 24-1*n* respectively, and the diodes 24-41 to 24-4*n* are connected in parallel to both ends of the switches 24-21 to 24-2*n* respectively. Further, the switch 24-1*a* (a: natural number equal to n or less) and the switch 24-2*a* are cascaded, each of the other ends of the switches 24-11 to 24-1*n* is connected to the negative line 28 in common, and each of the other ends of the switches 24-21 to 24-2*n* is connected to the positive line 27 in common. Moreover, the connection point between the switch 24-1*a* and the switch 24-2*a* is connected to the scanning electrode 3-*a* arranged on an a-th row from the top of the PDP 1. The switches 24-11 to 24-1*n* and 24-21 to 24-2*n* are turned ON/OFF based on the scanning pulse driver control signals Sspd 11 to Sspd 1*n* and Sspd 21 to Sspd 2*n* respectively, and voltages of a predetermined waveform Psc1 to Pscn are sequentially supplied to the scanning electrodes 3-1 to 3-*n*.

The sustaining driver 25 is composed of three switches 25-1 to 25-3, for example, as shown in FIG. 4. The sustaining voltage Vs is applied to one end of the switch 25-1, and the common electrodes 4-1 to 4-*n* are connected to the other end of the switch 25-1 in common. One end of the switch 25-2 is grounded, and the common electrodes 4-1 to 4-*n* are connected to the other end of the switch 25-2 in common. The bias voltage Vsw is applied to one end of the switch 25-3, and the common electrodes 4-1 to 4-*n* are connected to the other end of the switch 25-3 in common. The switches 25-1 to 25-3 are turned ON/OFF based on the sustaining driver control signals Ssud 1 to Ssud 3 respectively, and a voltage of a predetermined waveform Psu is supplied simultaneously to the common electrodes 4-1 to 4-*n*.

The data driver 26 is composed of m pieces of switches 26-11 to 26-1*m*, m pieces of switches 26-21 to 26-2*m*, m pieces of diodes 26-31 to 26-3*m*, and m pieces of diodes 26-41 to 26-4*m*, for example, as shown in FIG. 5. The diodes 26-31 to 26-3*m* are connected in parallel to both ends of the switches 26-11 to 26-1*m* respectively, and the diodes 26-41 to 26-4*m* are connected in parallel to both ends of the switches 26-21 to 26-2*m*. The switch 26-1*b* (b: natural number equal to m or less) and the switch 26-2*b* are cascaded, each of the other ends of the switches 26-11 to 26-1*m* is connected to the ground in common, and each of the other ends of the switches 26-21 to 26-2*m* is connected to the data voltage Vd in common. Moreover, the connection point between the switch 26-1*b* and the switch 26-2*b* is connected to the data electrode 10-*b* arranged on a b-th row from the left of the PDP 1. The switches 26-11 to 26-1*m* and 26-21 to 26-2*m* are turned ON/OFF based on the data driver control signals Sdd 11 to Sdd 1*m* and Sdd 21 to Sspd 2*m* respectively, and voltages of a predetermined waveform Pd1 to Pdm are sequentially supplied to the data electrodes 10-1 to 10-*m*.

Next, a write-selective driving operation of the conventional plasma display composed in the foregoing manner will be described. FIG. 6 is a timing chart showing the write-selective driving operation of the conventional plasma display. This write-selective driving operation adopts a sub-field method, and each sub-field is provided with four periods of a priming period Tp, an addressing period Ta, a sustaining period Ts, and a charge-erasing period Te, which are sequentially set. Hereinafter, a reference potential of the scanning electrode and the common electrode is set to the sustaining voltage Vs, and a potential higher than the sustaining voltage Vs is referred to as a positive polarity and a potential lower than the sustaining voltage Vs is referred to as a negative polarity. Further, a reference potential of the data electrode is set to a ground potential GND, and a potential higher than the ground potential GND is a positive polarity and a potential lower than the ground potential GND is a negative polarity.

In the priming period Tp, the controller 22 starts generating the scanning driver control signals Sscd 1 to Sscd 6, the sustaining driver control signals Ssud 1 to Ssud 3, and the scanning pulse driver control signals Sspd 11 to Sspd in and Sspd 21 to Sspd 2*n*, based on the video signal Sv supplied from the outside. The controller 22 also starts generating the data driver control signals Sdd 11 to Sdd 1*m* having a level based on the video signal Sv and the low level data driver signals Sdd 21 to Sdd 2*m*. Then the controller 22 supplies the control signals to the predetermined drivers.

As a result, in the priming period Tp, the high level scanning driver control signal Sscd 1 turns the switch 23-1 ON, and the high level sustaining driver control signals Ssud 2 turns the switch 25-2 ON. Therefore, the priming pulse Pprp of positive polarity is applied to all the scanning electrodes 3-1 to 3-*n*, and the priming pulse Pprp of negative polarity is applied to all the common electrodes 4-1 to 4-*n*. Accordingly, the priming discharge occurs in the discharge gas space 108 in the vicinity of inter-electrode gap between the scanning electrodes 103 (3-1 to 3-*n*) and the common electrodes 104 (4-1 to 4-*n*), in all the display cells. Thus, active particles, which make discharge of the display cell occur easily, are generated in the discharge gas space 108, negative wall charge adheres to the scanning electrodes 3-1 to 3-*n*, positive wall charge adheres to the common electrodes 4-1 to 4-*n*, and the positive wall charge adheres to the data electrodes 10-1 to 10-*m*.

Subsequently, the sustaining driver control signal Ssud 2 falls down to a lower level to turn the switch 25-2 OFF, and the sustaining driver control signal Ssud 1 rises up to a higher level to turn the switch 25-1 ON. Then, the scanning driver control signal Sscd 2 falls down to a lower level to turn the switch 23-2 OFF, and the scanning driver control signal Sscd 3 rises up to a higher level to turn the switch 23-3 ON. Therefore, a priming elimination pulse Ppre is applied to all the scanning electrodes 3-1 to 3-*n* after the potential of all the common electrodes 4-1 to 4-*n* is held at the sustaining voltage Vs of about 170V. Thus, weak discharge occurs in all the display cells. Accordingly, the negative wall charge on the scanning electrodes 3-1 to 3-*n*, the positive wall charge on the common electrodes 4-1 to 4-*n*, and the positive wall charge on the data electrodes 10-1 to 10-*m* reduce.

Next, in the initial state of the addressing period Ta, the high level sustaining driver control signal Ssud 3 turns the switch 25-3 ON, and the high level scanning driver control signal Sscd 4 and Sscd 5, which have been supplied from the latter priming period, turn the switches 23-4 and 23-5 ON. Accordingly, a bias pulse Pbp of positive polarity (bias voltage Vsw) is applied to all the common electrodes 4-1 to 4-*n*, and the potential of the pulses Psc 1 to Psc n applied to all the scanning electrodes 3-1 to 3-*n* is once held at the scanning base voltage Vbw.

In this state, the scanning pulse driver control signals Sspd 11 to Sspd 1n fall down sequentially to a lower level, and the scanning pulse driver control signals Sspd 21 to Sspd 2*n* rise up sequentially to a higher level synchronizing the signals Sspd 11 to Sspd 1*n*, and thus the switches 24-11 to 24-1*n* are sequentially turn e d OFF and the switches 24-21 to 24-2*n* are sequentially turned ON. Moreover, although not shown, the data drive control signals Sdd 11 to Sdd 1*m* rise up to a higher level based on the video signal Sv synchronously with the foregoing, and the data driver control signals Sdd 21 to Sdd 2*m* fall down synchronizing the signals Sdd 11 to Sdd 1*m*, and thus the switches 26-11 to 26-1*m* are turned ON based on the video signal Sv and the switches 26-21 to 26-2*m* are turned OFF. Thus, if writing is performed in the display cell at the a-th row and the b-th column, the scanning pulse Pwsn of negative polarity is applied to the scanning electrode 3-*a*, and the data pulse Pdb of positive polarity is simultaneously applied to the data electrode 10-*b* at the b-th column. As a result, matrix discharge occurs in the display cell at a-th row and b-th column, and furthermore, surface discharge triggered by the matrix discharge occurs between the scanning electrode and the common electrode as writing discharge and the wall charge adheres to the electrodes. On the other hand, the display cell where no writing discharge occurred is in the state where the wall charge quantity after the charge-erasing in the priming period Ta remains small.

Next, in the sustaining period Ts, the scanning driver control signals Sscd 2 and Sscd 6 alternately rise up/fall down repeatedly for the number of times corresponding to the sub-field. As a result, the switches 23-2 and 23-6 repeat ON/OFF alternately. Further, the sustaining driver control signals Ssud 1 and Ssud 2 alternately rise up/fall down repeatedly for a number of times corresponding to the sub-field synchronously with the foregoing. As a result, the switches 25-1 and 25-2 repeat ON/OFF alternately. Accordingly, sustaining pulses Psun 1 of negative polarity are applied to all the scanning electrodes 3-1 to 3-*n* for the number of times corresponding to the sub-field, and sustaining pulses Psun 2 of negative polarity are applied to all the common electrodes 4-1 and 4-*n* exclusively against the sustaining pulse Psun 1. Since the wall charge quantity of the display cell in which writing has not been performed in the addressing period Ta is extremely small, sustaining discharge does not occur even if the sustaining pulse is applied to the display cell. On the other hand, since the positive charge and the negative charge are respectively adhered to the scanning electrodes and the common electrodes in the display cell in which the writing discharge occurred in the addressing period Ta, the sustaining pulse and a wall charge voltage are superposed with each other, and the voltage between the electrodes exceeds a discharge starting voltage to occur discharge.

Next, in the charge-erasing period Te, the scanning driver control signal Sscd 3 rises up to turn the switch 23-3 ON. As a result, a charge eliminating pulse Peen of negative polarity is applied to all the scanning electrodes 3-1 to 3-*n*. Accordingly, weak discharge occurs in all the display cells. Thus, the wall charge accumulated on the scanning electrode and the common electrode in the display cells, which have been emitting light in the sustaining period Ts, is eliminated and the charge state of all the display cells is made uniform.

Then, the sub-field as described above is repeated to compose one field. The number of the sustaining pulse is changed in each sub-field, and gradation expression can be realized by combination of the sub-fields. Accordingly, if the ratio of the number of sustaining pulse for each sub-field is set in 1:2:4:8:16:32:64:128, for example, 256 ($=2^8$) gradations can be expressed.

In such a plasma display, power loss in the data driver greatly fluctuates depending on a video to be displayed, and power consumption of entire plasma display greatly depends on the maximum power loss in the data driver. For this reason, various displays in which power loss reduction in the data driver is intended are proposed (Japanese Patent No. 2853537, Japanese Patent Laid-Open No. Hei 11-38930). FIG. 7 is a block diagram showing a display disclosed in Japanese Patent Laid-Open No. Hei 11-38930.

In the display disclosed in Japanese Patent No. 2853537, an address current consumed in a unit of one frame, that is, a current value supplied from the data driver, is detected, and an addressing frequency is reduced when the value exceeds a predetermined value.

Further, in the display disclosed in Japanese Patent Laid-open No. Hei 11-38930, three driver integrated circuits (IC) 84 connected to data electrodes 52 of a PDP 51 with scanning electrodes 53 and common electrodes 54 are provided in an address driver circuit 83. The address driver circuit 83 is further provided with a temperature detection circuit 85. A control circuit 67 inputs a data signal DATA, a clock signal CLOCK, a blank signal BLANK and a latch signal LATCH to the address driver circuit 83. The control circuit 67 is provided with a display data controller 68 and a panel drive controller 69, the display data controller 68 generates the data signal DATA based on the video signal that has been input, and the panel drive controller 69 generates the clock signal CLOCK, the blank signal BLANK and the latch signal LATCH. A control signal from a microcomputer 81 is input to the control circuit 67. Note that a temperature detection result from the temperature detection circuit 85 is input to the microcomputer 81, and the microcomputer 81 also controls an operation of a power source 82 that supplies a power source voltage to the address driver circuit 83 based on the detection result.

According to the foregoing display, the power source voltage can be controlled corresponding to the temperature of the address driver circuit 83.

Note that display where the maximum power loss occurs in the data driver is one-dot stagger display, that is, when one display cell is in a light emission state, all display cells adjacent (above, under, right and left) to the display cell are in a non-emission state, and furthermore, all display cells adjacent (above, under, right and left) to these display cells in the non-emission state are in an emission state, and such relation is formed in entire panel.

However, since detection of the current consumption is performed in one frame unit of the display disclosed in Japanese Patent No. 2853537, no protection is performed unless the current consumption in entire one frame exceeds the reference value even if the sub-field whose current consumption becomes temporarily high is in one frame, for example, even if sub-fields whose current consumption becomes high exist continuously in the latter part of one frame and in the front part of subsequent frame. Therefore, load to the power source may be enormous. Although a driver is provided for each data electrode, the current consumption in one driver may be extremely large because detection of current consumption cannot be made even if the load given to the driver becomes large.

Furthermore, since only temperature detection is performed in the display disclosed in Japanese Patent Laid-Open No. 11-38930, there exists a problem that load to the power source and individual driver cannot be detected directly. For this reason, a temperature as a reference needs to be reduced in order to appropriately reduce the current consumption, and thus causing excessive protection in temperature.

SUMMARY OF THE INVENTION

It is an object of the present invention to provide a plasma display that can appropriately protect its circuit while avoiding excessive protection and a driving method thereof.

A plasma display according to one aspect of the present invention comprises a plasma display panel. The plasma display panel includes first and second substrates arranged to face with each other, scanning electrodes and common electrodes alternately provided with each other on a side of the first substrate facing the second substrate and extending in a first direction, and data electrodes provided on a side of the second substrate facing the first substrate and extending in a second direction across the first direction. The plasma display further comprises data drivers which apply data pulse to the data electrodes, a control circuit which controls operation of the data drivers based on a video signal, and a protection signal output circuit which outputs a first protection signal to the control circuit when sum of currents supplied from the data drivers to the data electrodes within a time equal to one sub-field or more to less than one frame exceeds a previously set first specified current value. The first protection signal restrains the operation of the data drivers.

In the present invention, the sum of currents within the time equal to one sub-field or more to less than one frame is compared with the first specified current value, and the control circuit controls the operation of the data driver based on the comparison result. Therefore, the power source can be appropriately protected even if the sub-field whose current consumption is high exists. Note that the sum of currents is not limited to one in all the data drivers, but the data drivers may be divided into a plurality of groups and the first specified current value may be set for each group. However, it is when the first specified current value is set for the sum of currents in all the data drivers that power source can be protected most effectively.

If the protection signal output circuit judges whether or not a current supplied from at least one data driver among the data drivers to the data electrode has exceeded a previously set second specified current value, and outputs a second protection signal to the control circuit when the current supplied to the one data driver has exceeded the second specified current value, which second protection signal restrains the operation of the one data driver, power loss in individual data driver can be reduced appropriately.

A plasma display according to another aspect of the present invention comprises a plasma display panel. The plasma display panel includes first and second substrates arranged to face with each other, scanning electrodes and common electrodes alternately provided with each other on a side of the first substrate facing the second substrate and extending in a first direction, and data electrodes provided on a side of the second substrate facing the first substrate and extending in a second direction across the first direction. The plasma display further comprises data drivers which apply data pulse to the data electrodes, a control circuit which controls operation of the data drivers based on a video signal, and a protection signal output circuit which judges whether or not a current supplied from at least one data driver among the data drivers to the data electrode has exceeded a previously set second specified current value, and outputs a second protection signal to the control circuit when the current supplied to the one data driver has exceeded the second specified current value. The second protection signal restrains the operation of the one data driver.

If protection signal output circuit starts the judgment when a temperature around the data drivers exceeds a previously set specified temperature, excessive protection can be surely avoided.

A driving method of a plasma display according to further another aspect of the present invention comprises the step of restraining an operation of data drivers when sum of currents supplied from the data drivers to data electrodes within a time equal to one sub-field or more to less than one frame exceeds a previously set first specified current value.

A driving method of a plasma display according to still further another aspect of the present invention comprises the steps of judging whether or not a current supplied from at least one data driver among data drivers to data electrodes has exceeded a second specified current value, and restraining, when the current supplied to the one data driver exceeds the second specified current value, the operation of the one data driver.

In addition, excessive protection can be surely avoided if current detection in individual data driver is performed after the temperature detection.

BRIEF DESCRIPTION OF THE DRAWINGS

FIG. 13 is a view showing a protective operation with nine steps.

DETAILED DESCRIPTION OF THE PREFERRED EMBODIMENTS

Figure 8:
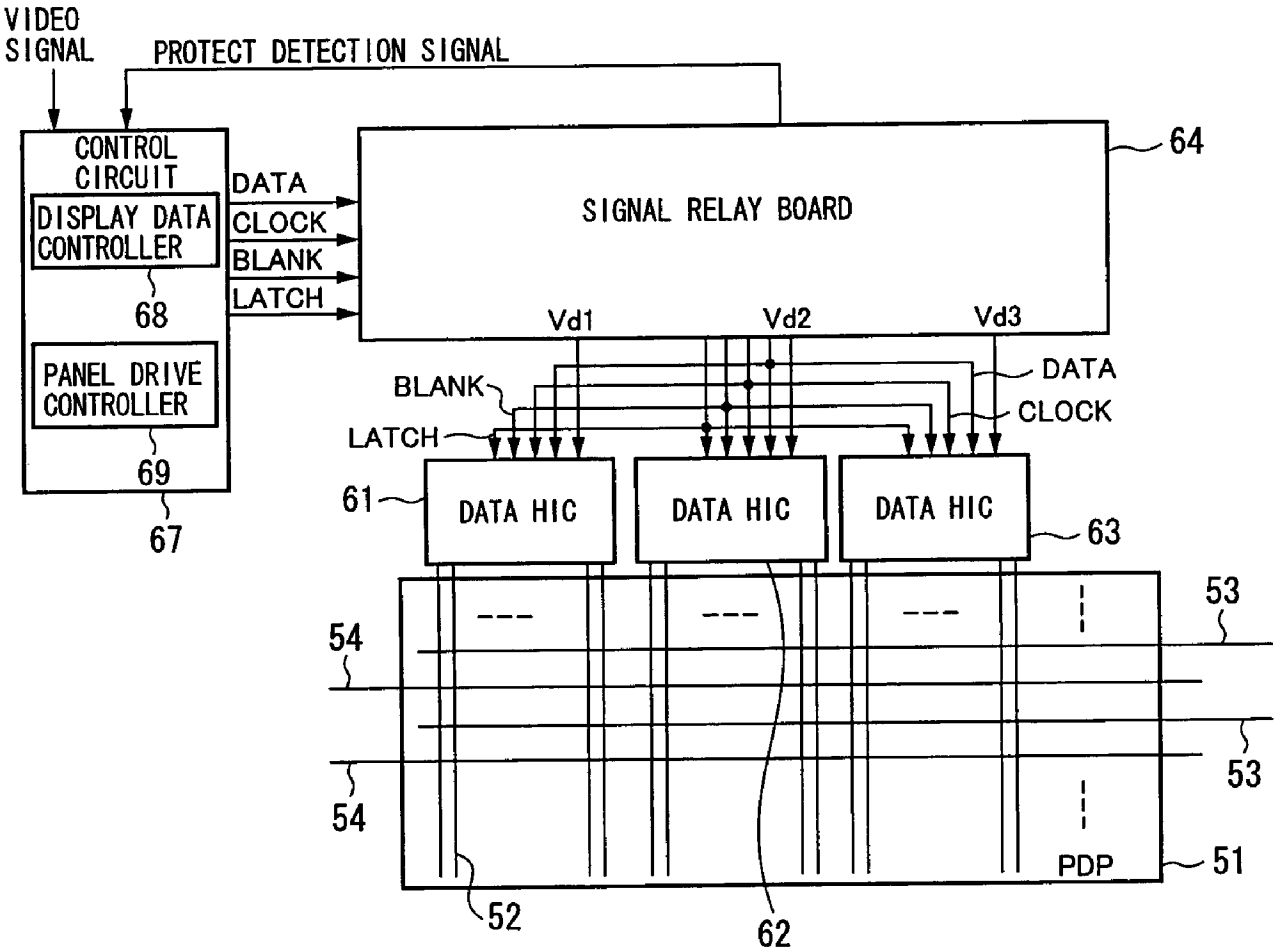
FIG. 8 is a block diagram showing a configuration of a plasma display according to an embodiment of the present invention.

Preferred embodiments of the present invention will be specifically described with reference to the accompanying drawings. FIG. 8 is a block diagram showing a configuration of a plasma display according to an embodiment of the present invention.

In the present embodiment, the plasma display panel (PDP) 51 is provided with n pieces of the scanning electrodes 53, n pieces of the common electrodes 54, and (3×m) pieces of the data electrodes 52. The scanning electrodes 53 and the common electrodes 54 are arranged alternately with each other so as to extend in horizontal direction (row direction), and the data electrodes 52 are arranged orthogonal to the scanning electrodes 53 and the common electrodes 54, that is, so as to extend in perpendicular direction (column direction). The scanning electrodes 53 are connected to the scanning pulse driver (not shown), and the common electrodes 54 are connected to the sustaining driver (not shown). Regarding the data electrodes 52, the data electrodes 52 from the first column to the m-th column are connected to a data hybrid integrated circuit (data HIC) 61, the data electrodes 52 from the (m+1)-th column to the (2×m)-th column are connected to a data HIC 62, and the data electrodes 52 from the (2×m+1)-th column to the (3×m)-th column are connected to a data HIC 63. The data HICs 61 to 63 correspond to the data driver.

Figure 9:
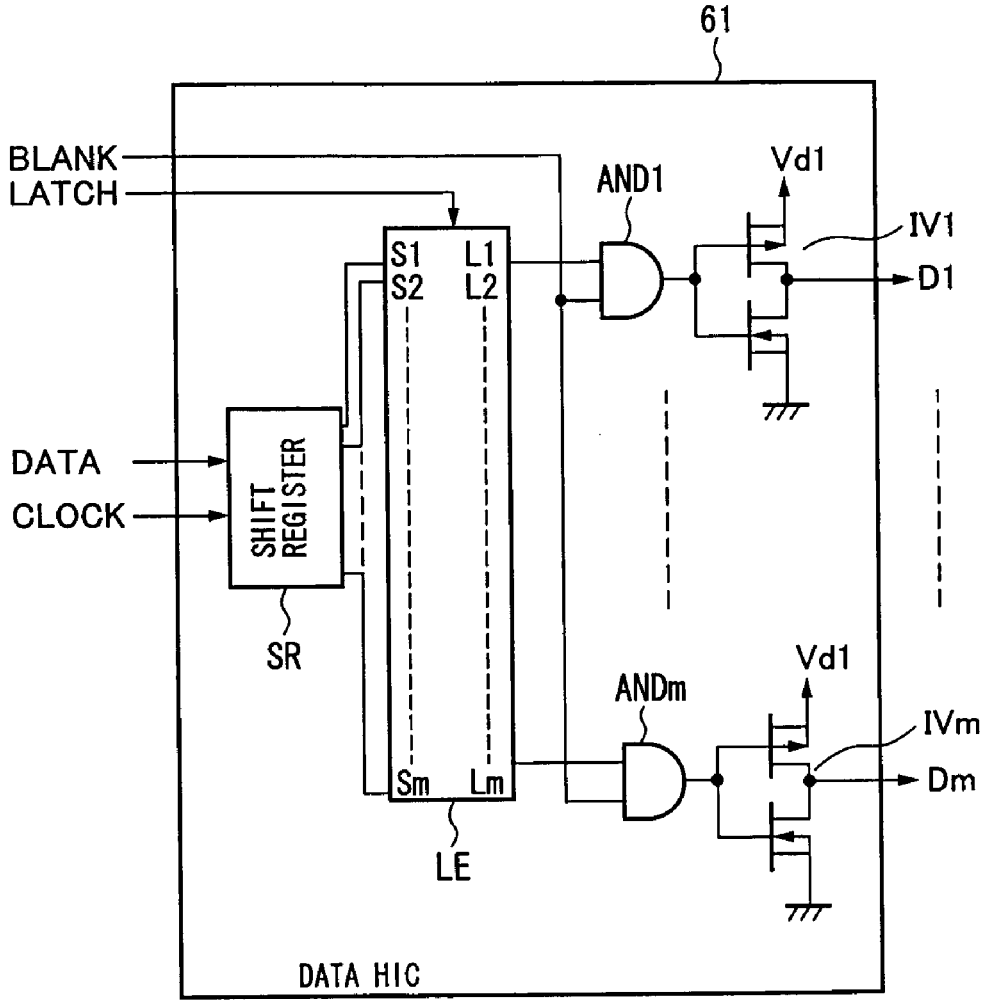
FIG. 9 is a block diagram showing a structure of a data HIC 61.

FIG. 9 is a block diagram showing a structure of the data HIC 61. The data HIC 61 is provided with a shift register SR to which the data signal DATA and the clock signal CLOCK are input, a latch circuit LE that latches the data signal output form the shift register SR, an AND gates AND1 to ANDm having two input terminals where output signals from output terminals L1 to Lm of the latch circuit LE are input to one of the input terminals respectively, and inverters IV1 to IVm that consist of CMOS transistors, where output signals from the AND gates AND1 to ANDm are input to gates thereof respectively. The latch signal LATCH that instructs output timing is input to the latch circuit LE, and the blank signal BLANK that is high in the addressing period and low in other periods is input to the other input terminals of the AND gates AND1 to ANDm. The data voltage Vd1 is supplied to the drain of a P-channel MOS transistor, and the drain of a N-channel MOS transistor is grounded, both of which composes the CMOS transistor of the inverters IV1 to IVm. An output signal of the inverter IVk (k is a natural number equal to m or less) is output as a data pulse Dk to the data electrode of the k-th column.

Although structures of the data HICs 62 and 63 are substantially the same as that of the data HIC 61, they are different from the data HIC 61 on the point that data voltages Vd2 and Vd3 as a data voltage are supplied to the data HICs 62 and 63 respectively.

Figure 10:
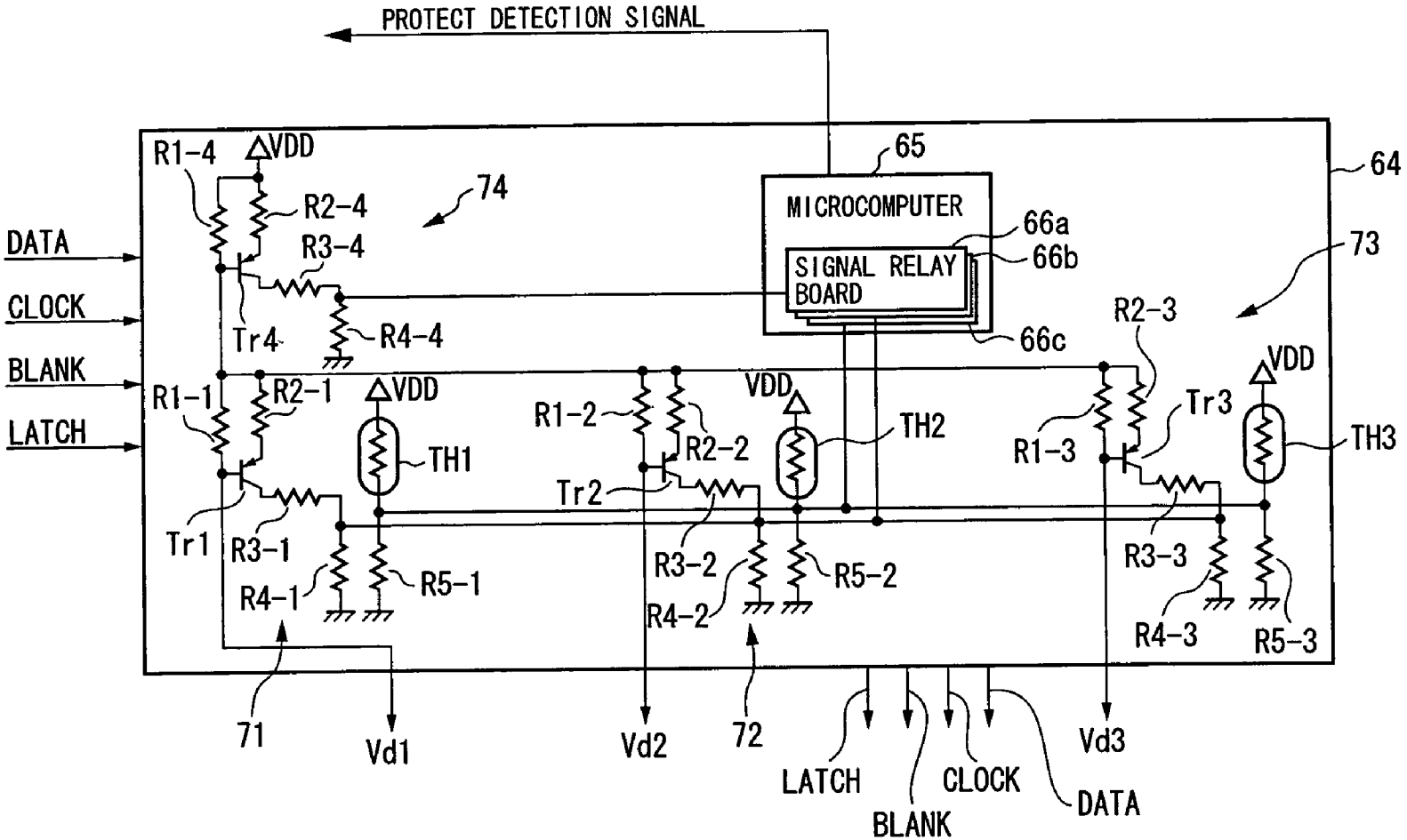
FIG. 10 is a circuit diagram showing a structure of a signal relay board 64.

The data HICs 61, 62 and 63 are connected to the signal relay board 64. FIG. 10 is a circuit diagram showing a structure of the signal relay board 64. The signal relay board 64 is provided with resistance elements R1-4 and R2-4 to which a power source (not shown) supplies a power source voltage VDD. The other end of the resistance element R1-4 is connected to the base of a bipolar transistor Tr4, and the other end of the resistance element R2-4 is connected to the emitter of the bipolar transistor Tr4. Resistance elements R3-4 and R4-4 are connected in series between the collector of the bipolar transistor Tr4 and the ground. An analog/digital (A/D) converter 66*a* built in a microcomputer 65 is connected to the connection point of the resistance elements R3-4 and R4-4.

Furthermore, resistance elements R1-1, R2-1, R1-2, R2-2, R1-3 and R2-3 are connected in parallel to the base of the bipolar transistor Tr4. The other end of the resistance element R1-1 is connected to the base of a bipolar transistor Tr1, and the other end of the resistance element R2-1 is connected to the emitter of the bipolar transistor Tr1. Resistance elements R3-1 and R4-1 are connected in series between the collector of the bipolar transistor Tr1 and the ground. Similarly, the other end of the resistance element R1-2 is connected to the base of a bipolar transistor Tr2, and the other end of the resistance element R2-2 is connected to the emitter of the bipolar transistor Tr2. Resistance elements R3-2 and R4-2 are connected in series between the collector of the bipolar transistor Tr2 and the ground. Furthermore, the other end of the resistance element R1-3 is connected to the base of a bipolar transistor Tr3, and the other end of the resistance element R2-3 is connected to the emitter of the bipolar transistor Tr3. Resistance elements R3-3 and R4-3 are connected in series between the collector of the bipolar transistor Tr3 and the ground. The connection point of the resistance elements R3-1 and R4-1, the connection point of the resistance elements R3-2 and R4-2, and the connection point of the resistance elements R3-3 and R4-3 are connected to an A/D converter 66*b* built in the microcomputer 65 in common.

Furthermore, there are provided thermistors TH1 to TH3 to which the power source voltage VDD is supplied. Resistance elements R5-1 to R5-3 are connected between the thermistors TH1 to TH3 and the ground respectively. The connection point of the thermistor TH1 and the resistance element R5-1, the connection point of the thermistor TH2 and the resistance element R5-2, and the connection point of the thermistor TH3 and the resistance element R5-3 are connected to an A/D converter 66c built in the microcomputer 65 in common. The thermistors TH1 to TH3 are respectively arranged in the vicinity of the data HICs 61 to 63.

The microcomputer (protection signal output circuit) 65 as a micro-program control unit (MCU) outputs one of protect detection signals (first to fourth protection signals) to the control circuit 67 when a predetermined temperature or current value exceeds a predetermined value, based on digital signals output from the A/D converters 66*a* to 66*c*. The control circuit 67 is provided with the display data controller 68 and the panel drive controller 69, where the display data controller 68 generates the data signal DATA, and the panel drive controller 69 generates the clock signal CLOCK, the blank signal BLANK, and the latch signal LATCH, based on the input video signal. Further, the control circuit 67 controls the scanning pulse driver, the sustaining driver and the like (not shown) similarly to the conventional manner.

Figure 11:
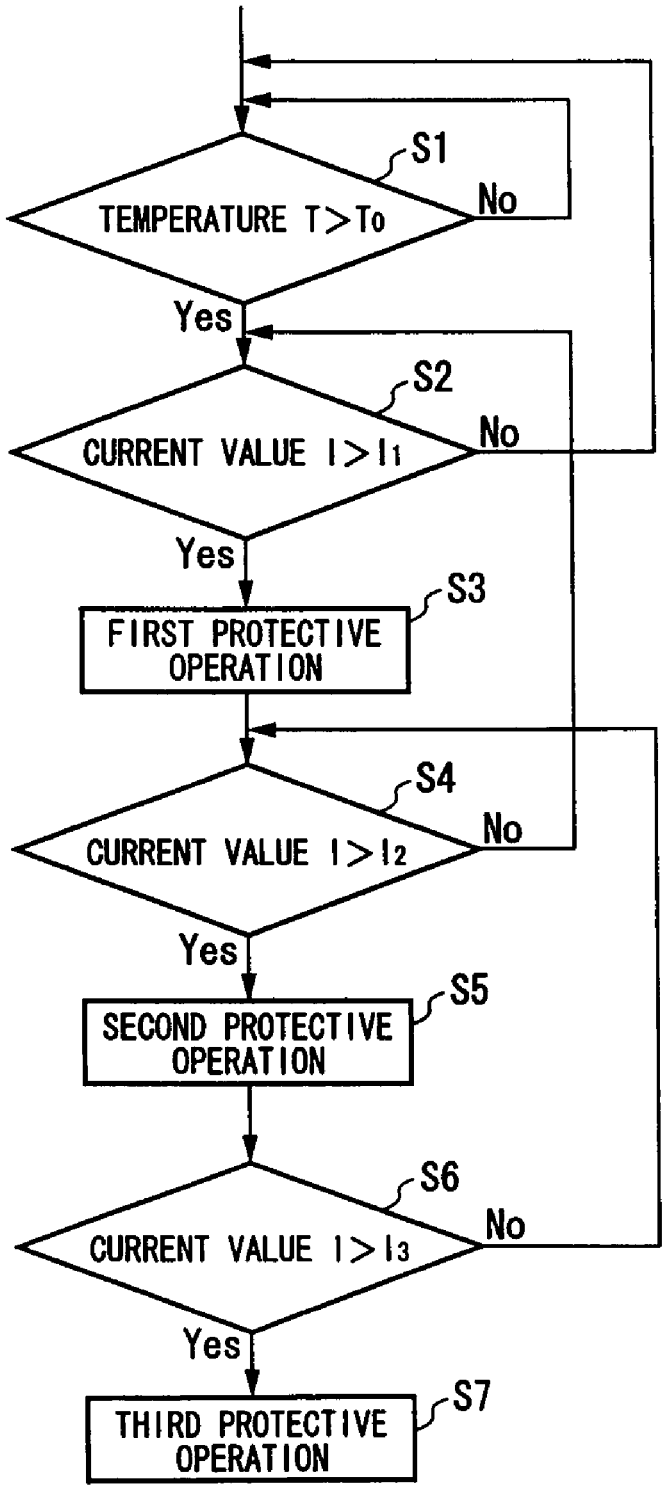
FIG. 11 is a flowchart showing an operation of the plasma display according to the embodiment of the present invention.
Figure 12:
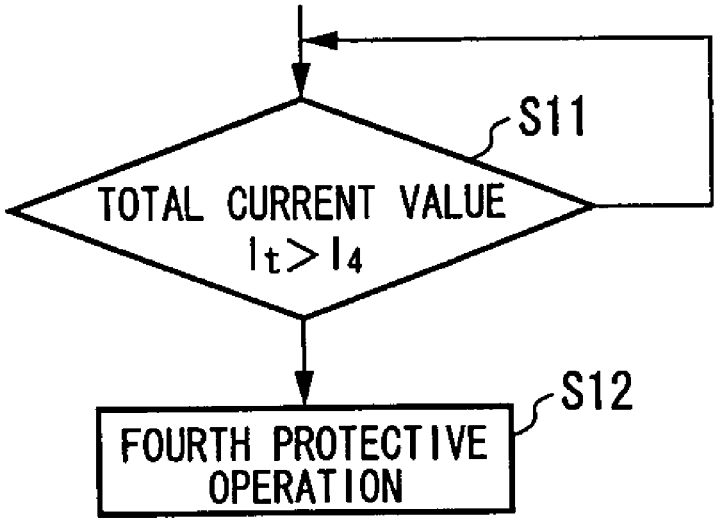
FIG. 12 is also a flowchart showing an operation of the plasma display according to the embodiment of the present invention.

Next, the operation of the present embodiment composed as described above will be described. FIGS. 11 and 12 are the flowcharts showing the operation of the plasma display according to the embodiment of the present invention. In the description of the following operation, it is assumed that one frame consists of eight sub-fields SF1 to SF8 and displaying 256 gradations can be capable. It is also assumed that a progressive display is performed when a protective operation is not performed.

In the present embodiment, when the video signal is input to the control circuit 67, the control circuit 67 outputs the data signal DATA, the clock signal CLOCK, the blank signal BLANK, and the latch signal LATCH to the signal relay board 64. In the signal relay board 64, only the blank signal BLANK is input to the microcomputer 65 and the other signals the data signal DATA, the clock signal CLOCK and the latch signal LATCH are only relayed and directly output to the data HICs 61 to 63.

In the data HIC 61, the data signal DATA is taken into the shift register SR synchronously with the clock signal CLOCK, and is latched by the latch circuit LE while the latch signal LATCH is in a low level. Then, the data signal is output to the AND gates AND1 to ANDm when the latch signal LATCH becomes high, and inverted by the inverters IV1 to IVm to be output as data pulses D1 to Dm to each data electrode 52 if the blank signal BLANK is in a high level.

As a result, the current supplied to the source of the P-channel MOS transistor of each inverter IV1 to IVm fluctuates. Such operation is simultaneously performed in the data HICs 62 and 63, the current supplied to the source of each P-channel MOS transistor fluctuates similarly.

In the signal relay board 64, the temperature detected by the thermistors TH1 to TH3 is converted into a voltage, and it is further converted into a digital signal by the A/D converter 66*c*. Further, an individual power detection section 71, which is composed of the resistor elements R1-1, R2-1, R3-1, R4-1 and R5-1 and the bipolar transistor Tr1, detects the current value supplied to the data HIC 61. An individual power detection section 72, which is composed of the resistor elements R1-2, R2-2, R3-2, R4-2 and R5-2 and the bipolar transistor Tr2, detects the current value supplied to the data HIC 6. An individual power detection section 73, which is composed of the resistor elements R1-3, R2-3, R3-3, R4-3 and R5-3 and the bipolar transistor Tr3, detects the current value supplied to the data HIC 63. Then, the A/C converter 66*b* converts the currents into the digital signals. Moreover, a total power detection section 74, which is composed of the resistor elements R1-4, R2-4, R3-4, R4-4 and R5-4 and the bipolar transistor Tr4, detects sum of the current values supplied to the data HICs 61, 62 and 63.

Then, the microcomputer 65 recognizes the beginning of the addressing period with rising up of the blank signal BLANK as a trigger, and judges whether or not at least one of temperatures T detected by the thermistors TH1 to TH3 has exceeded a specified temperature $T_0$ (step S1). If none of the temperatures has exceeded the specified temperature $T_0$, temperature judgment is performed again after passage of a predetermined time.

In the case where at least one temperature exceeds the specified temperature $T_0$, the microcomputer 65 judges whether or not at least one of current values 'I' detected by the individual power detection sections 71 to 73 has exceeded a specified current value $I_1$ (step S2). In this judgment, the current value flowed in 10 microseconds is detected for ten times and it is discriminated whether or not the current value has exceeded the specified current value $I_1$ in six times or more, for example, and the process from the detection to the discrimination is repeated for ten times, for example. Then, the microcomputer 65 judges that at least one of the current values 'I' detected by the individual power detection sections 71 to 73 has exceeded the specified current value $I_1$ when it is discriminated that the current values 'I' exceed the specified current value $I_1$ for six consecutive processes. If none of the current values 'I' has exceeded the specified current value $I_1$, temperature judgment is performed again after passage of a predetermined time.

If at least one current value has exceeded the specified current value (second specified current value) $I_1$, the microcomputer 65 outputs an instruction for performing a first protective operation as the protect detection signal (second protection signal) to the control circuit 67. On receiving the protect detection signal, the control circuit 67 deletes the sub-field SF1 of a least significant bit, for example. In other words, one frame is composed of seven sub-fields SF2 to SF8 to reduce the gradation to 128 (step S3). Subsequently, the microcomputer 65 judges whether or not at least one of the current values 'I' detected by the individual power detection sections 71 to 73 has exceeded the specified current value (third specified current value) $I_2$ (step S4). The specified current value $I_2$ is set to a larger value than the specified current value $I_1$, for example. This judgment can also be performed by a similar method, for example, to the judgment whether or not at least one of the current values 'I' has exceeded the specified current value $I_1$. Then, if neither current values 'I' has exceeded the specified current value $I_2$, it is considered that the current has been reduced sufficiently by the first protective operation, and the judgment is performed again whether or not the current value has exceeded the specified current value $I_1$.

If at least one current value has exceeded the specified current value $I_2$, it is considered that the current has not been reduced sufficiently by the first protective operation, and the microcomputer 65 outputs an instruction for performing a second protective operation as the protect detection signal (third protection signal) to the control circuit 67. On receiving the protect detection signal, the control circuit 67 deletes the sub-field SF2 superior to the sub-field SF1 by one, for example. In other words, one frame is composed of six sub-fields SF3 to SF8 to reduce the gradation to 64 (step S5). Subsequently, the microcomputer 65 judges whether or not at least one of the current values 'I' detected by the individual power detection sections 71 to 73 has exceeded the specified current value (fourth specified current value) $I_3$ (step S6). The specified current value $I_3$ is set to a larger value than the specified current value $I_2$, for example. This judgment can also be performed by a similar method, for example, to the judgment whether or not at least one of the current values 'I' has exceeded the specified current value $I_1$. Then, if neither current values 'I' has exceeded the specified current value $I_3$, it is considered that the current has been reduced sufficiently by the second protective operation, and the judgment is performed again whether or not the current value has exceeded the specified current value $I_2$.

If at least one current value has exceeded the specified current value $I_3$, it is considered that the current has not been reduced sufficiently by the second protective operation, and the microcomputer 65 outputs an instruction for performing a third protective operation as the protect detection signal (fourth protection signal) to the control circuit 67. On receiving the protect detection signal, the control circuit 67 switches the progressive display to an interlace display that simultaneously drives adjacent two display rows. In other words, timing for latching the data signal DATA is set every two bits, and furthermore, timing for latching the data signal DATA is shifted by one bit between an odd field and an even field (step S7).

Further, with a routine different from the steps S1 to S7, the microcomputer 65 judges whether or not a current It detected in every time equal to one sub-field or more to one frame or less by the total power detection section 74 has exceeded the specified current value (first specified current value) $I_4$ (step S11).

If the current $I_t$ has exceeded the specified current value $I_4$, the microcomputer 65 outputs an instruction for performing a fourth protective operation as the protect detection signal (first protection signal) to the control circuit 67. On receiving the protect detection signal, the control circuit 67 switches the progressive display to the interlace display that simultaneously drives adjacent two display rows similar to the third protective operation, for example (step S12).

With regard to the specified current values $I_1$ to $I_4$, assuming that sum of currents that flow in one signal relay board in displaying one-dot stagger, where power consumption is largest, is 100, the specified current values $I_1$, $I_2$, $I_3$, and $I_4$ can be set to 16, 18, 20 and 50 respectively, because an individual current supple to three data HICs in motion video display of normal television broadcasting is about 20 to 30 at largest. However, the present invention is not limited to these.

In the present embodiment, since temperature comparison and individual current value comparison in three steps are performed, appropriate protection can be performed to each data HIC 61 to 63 while avoiding excessive protection. Further, sum of currents It supplied to the three HICs (61 to 63) connected to one signal relay board 64 is always compared to the specified current value $I_4$, the fourth protective operation is performed, which is the same the third protective operation having the most effective current reduction among the first to the third protective operations, when the sum of currents $I_t$ exceeds the specified current value $I_4$, and thus load to the power source can be reduced quickly.

Although one signal relay board 64 and three data HICs 61 to 63 are provided to one PDP 1 in the foregoing embodiment, two or more signal relay boards may be provided, or alternatively, two or more than three data HICs may be provided. Further, when two or more signal relay boards are provided, the number of the data HICs connected to each signal relay board needs not be the same for every signal relay board. For example, three data HICs may be connected to one signal relay board and four data HICs may be connected to another signal relay board.

Moreover, a method of judging whether or not individual current or sum of currents has exceeded each specified current value is not limited to the foregoing method, and detection time and/or detection number may be different from those.

Furthermore, each protective operation is not limited to the one in the foregoing embodiment as well. For example, entire inferior sub-field is not deleted, but application of the data pulse in the sub-field during the addressing period may be stopped while the sub-field is allowed to remain. However, since image quality may be deteriorated due to reduction of a gradation number if the number of sub-fields to be deleted is too large and flicker may occur when display is switched to the interlace display, to which attention needs to be paid.

Next, effect of reducing power consumption will be described based on simulation in the case where one frame is composed of eleven fields. FIG. 13 is the view showing the protective operation with nine steps. Reference codes (P), (I) and (C) denote that the progressive display is performed, that the interlace display is performed, and that application of the data pulse in a sub-field is deleted as a change of coding, respectively. Further, a ratio shows a proportion that the sub-field occupies in one frame. Although the ratio of actual video occasionally changes in accordance with the video, the ratio was set based on the assumption of an average video. In the simulation, a protective operation 0 proceeded to a protective operation 1 when the temperature exceeded a specified temperature, then display was switched to the interlace display starting from the inferior sub-field every certain amount of time. Furthermore, application of the data pulse was deleted after switching inferior three sub-fields to the interlace display.

Figure 14:
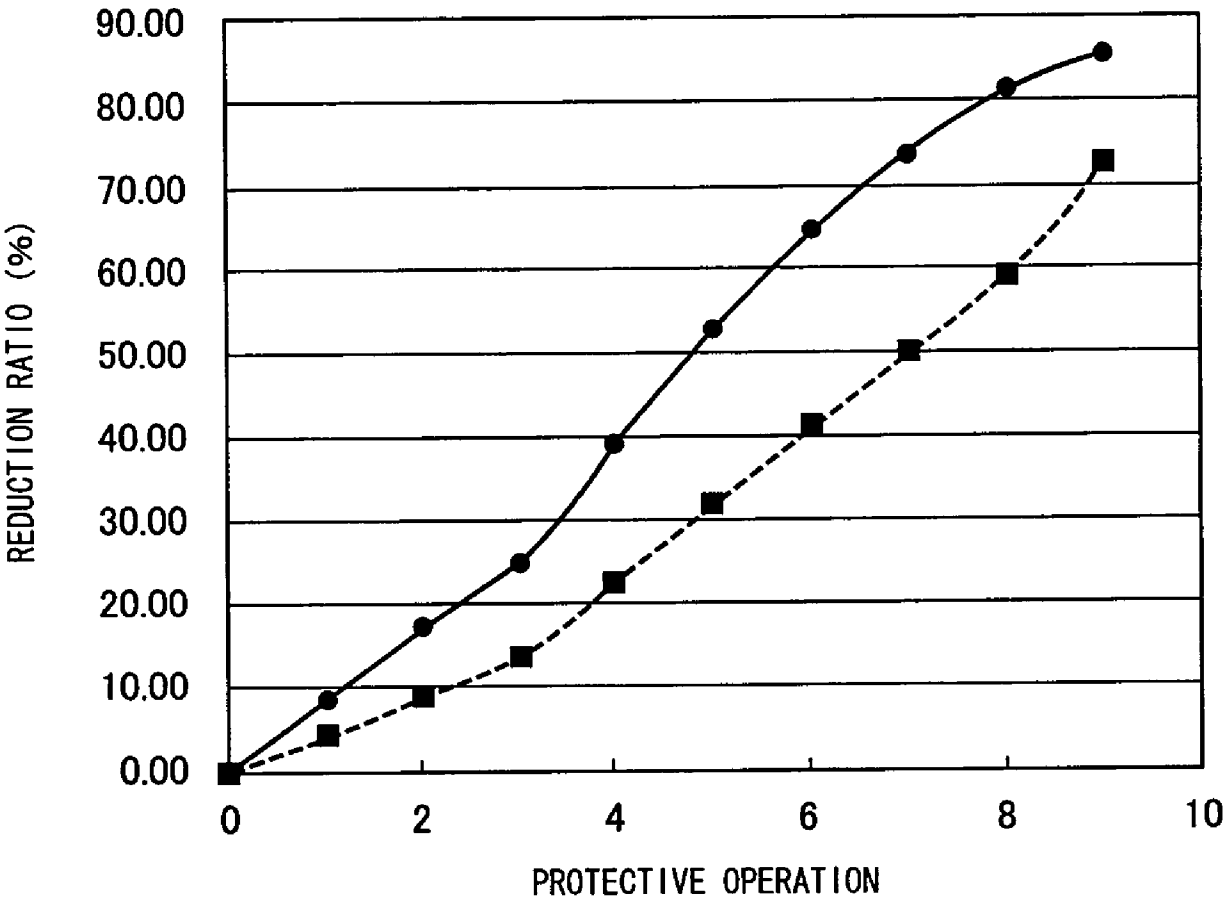
FIG. 14 is a graph showing reduction rate of power consumption due to the protective operation with nine steps.

FIG. 14 is the graph showing reduction rate of power consumption due to the protective operation with nine steps. In FIG. 14, a solid line shows the reduction ratio in the actual video, and a broken line shows the reduction ratio in one-dot stagger. When the foregoing protective operation with nine steps was performed, the power consumption of the actual video was reduced more. This is because the actual video has higher ratio of the inferior sub-fields as shown in FIG. 13, and reduction of power consumption due to reduction of these sub-fields causes great affect. However, effect of reducing power consumption may be larger in one-dot stagger depending on a type of actual video.

Figure 15:
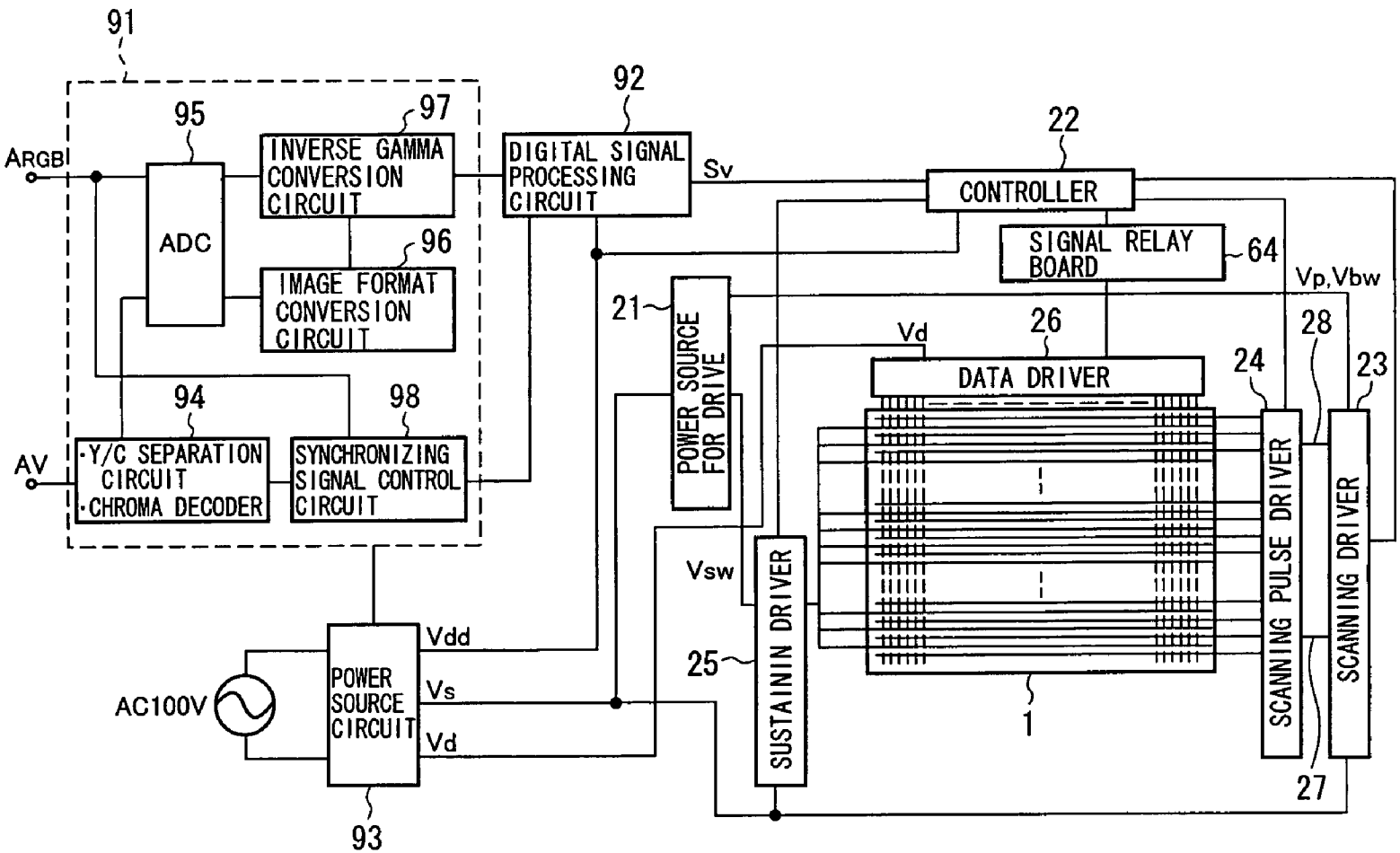
FIG. 15 is a block diagram showing an embodiment of a display structure where the present invention is applied.

Note that the plasma display according to the present invention can be used as a display such as a television receiver and a computer monitor. FIG. 15 shows a configuration example of the plasma display (PDP multi-media monitor) to which the present invention is applied. In FIG. 15, the same reference numerals are applied to the same constituent elements of the conventional plasma display shown in FIG. 2, and their detail description will be omitted. This plasma display is provided with an analog interface circuit 91 and a digital signal processing circuit 92 on a previous stage of the PDP 1 and driving circuits thereof. A power source circuit 93 that supplies a direct voltage from the alternating voltage 100V to each section of the unit is further provided. The analog interface circuit 91 may be composed of, a Y/C separation circuit and chroma decoder 94, an analog-digital converter (ADC) 95, an image format conversion circuit 96, an inverse gamma conversion circuit 97, and a synchronizing signal control circuit 98.

The Y/C separation circuit and chroma decoder 94 resolves an analog video signal $A_v$ into each luminance signal of red (R), green (G) and blue (B) in the case where the display is used as a display of television receiver. The ADC 95 is a circuit that converts an analog RGB signal $A_{RGB}$ into a digital RGB signal when the display is used as a monitor of computer or the like. The ADC 95 converts the luminance signal of each color (R, G and B) supplied from the Y/C separation circuit and chroma decoder 94 into a digital luminance signal of each color (R, G and B) when the display is used as a display of television receiver. The image format conversion circuit 96 is a circuit that converts a pixel configuration of the digital luminance signal of each color (R, G and B) to adapt for a pixel configuration of the PDP 1 when the pixel configurations of the PDP 1 and the digital luminance signal of each color (R, G and B) supplied from the ADC 95 are different. The inverse gamma conversion circuit 97 is a circuit that performs inverse gamma correction to characteristics of the digital RGB signal, to which gamma correction has been performed to adapt for gamma characteristics of a CRT, and the digital luminance signal of each color (R, G and B) supplied from the image format conversion circuit 96, so as to adapt for linear gamma characteristics of the PDP 1. The synchronizing signal control circuit 98 is a circuit that generates a sampling clock signal and a data clock signal of the ADC 95 based on a horizontal synchronizing signal supplied with the analog video signal $A_v$.

Figure 1:
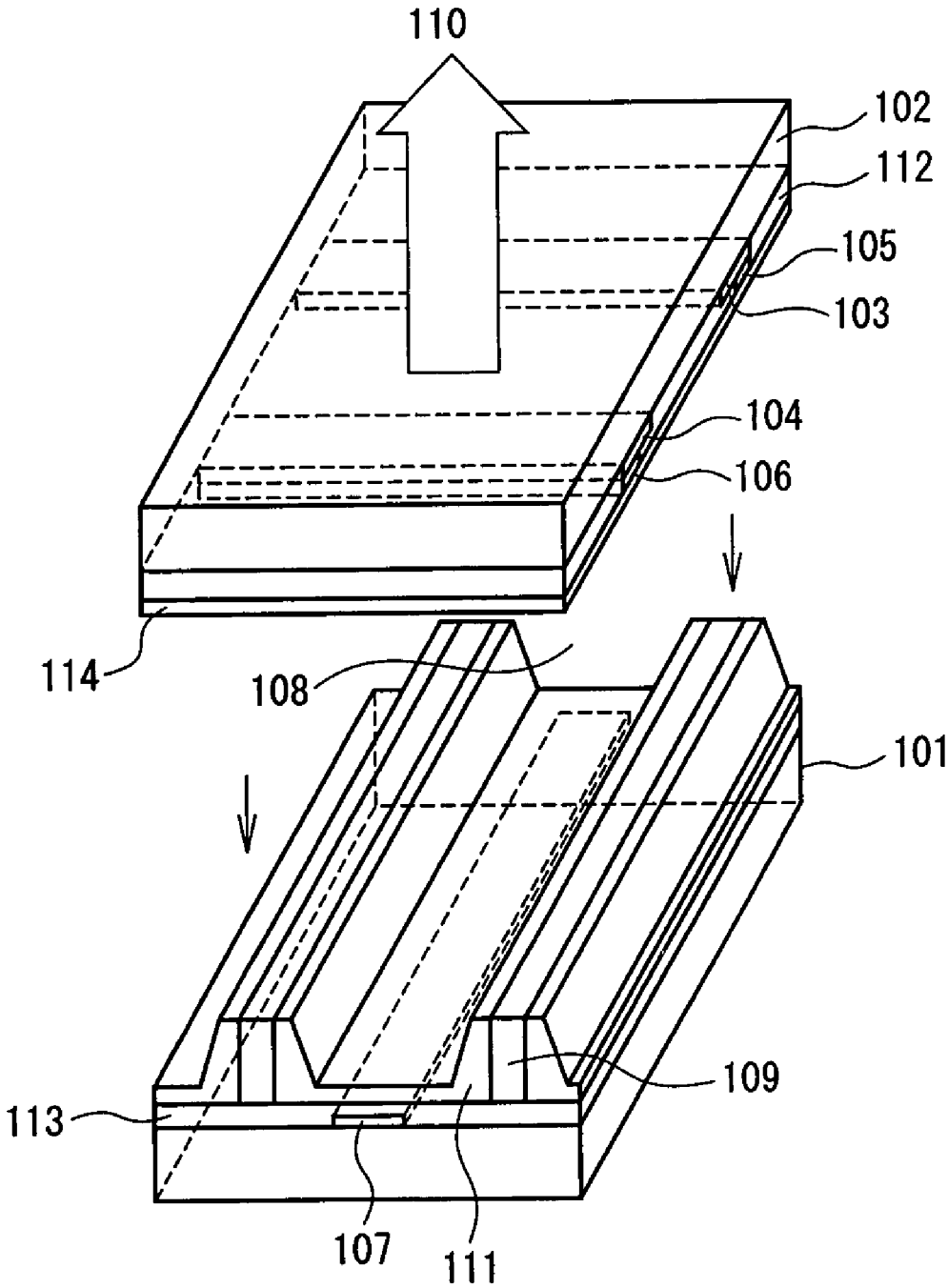
FIG. 1 (PRIOR ART)
FIG. 1 is a perspective view exemplifying one display cell configuration of an AC type plasma display.
Figure 2:
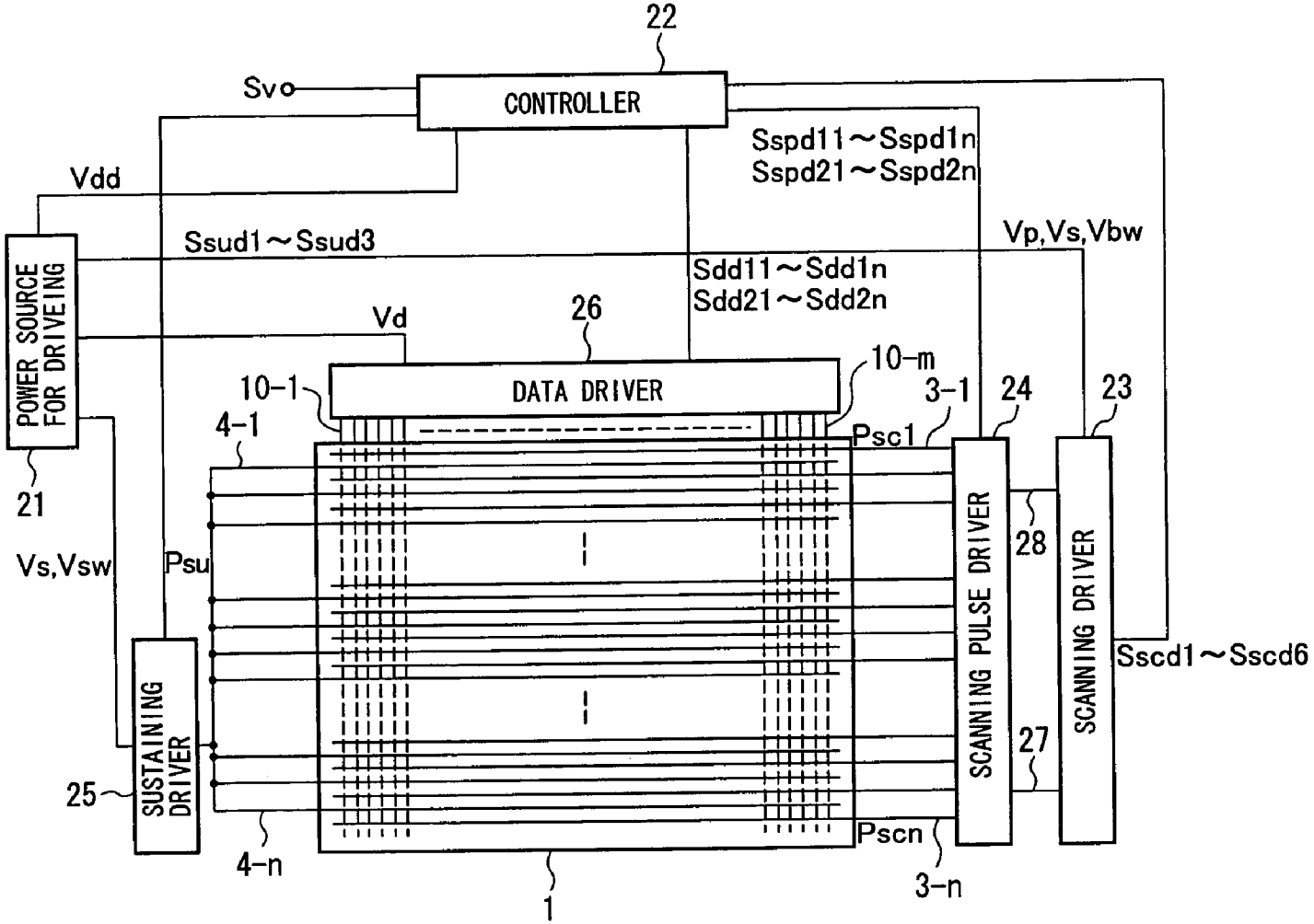
FIG. 2(PRIOR ART)
FIG. 2 is a block diagram showing a conventional AC type plasma display.
Figure 3:
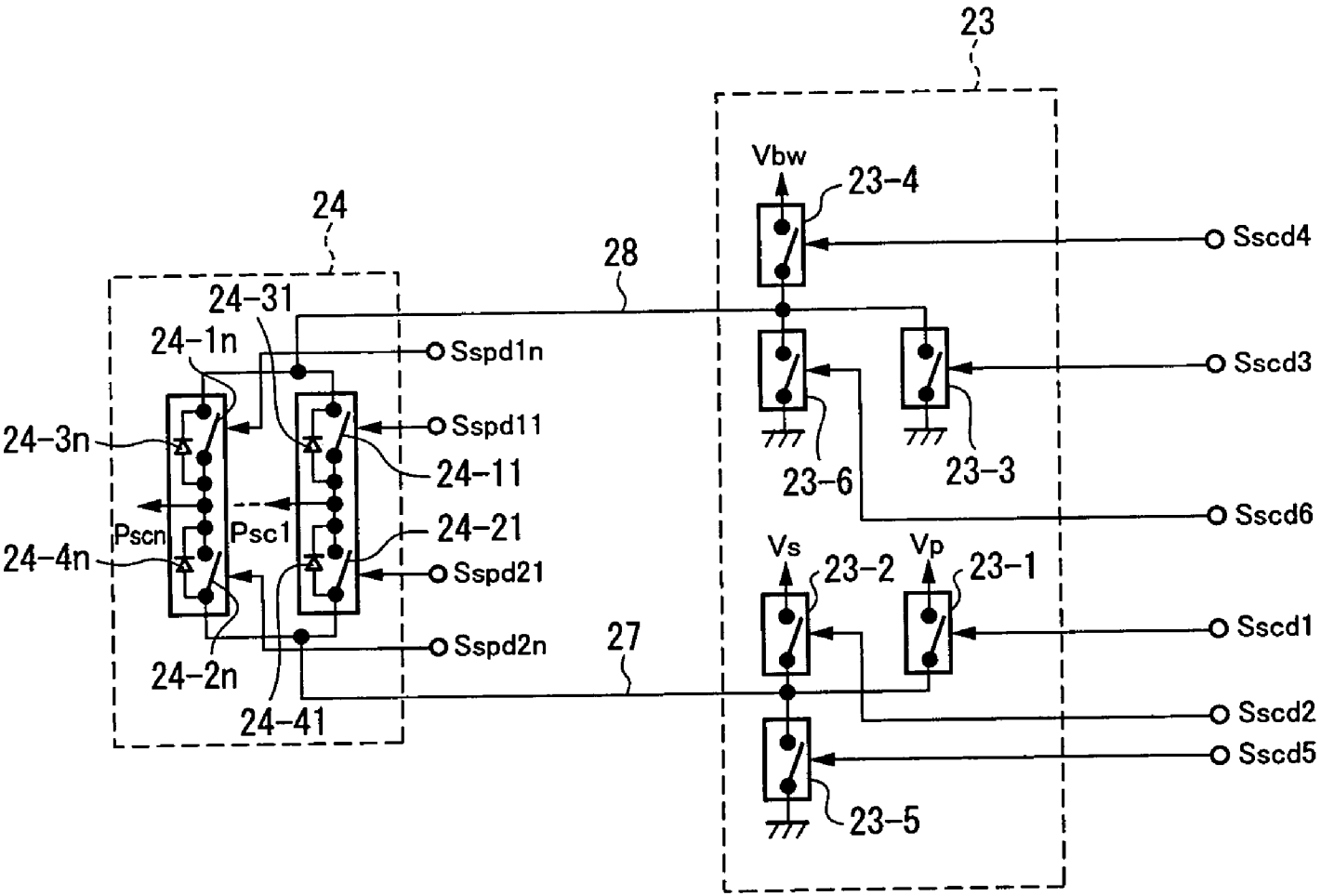
FIG. 3(PRIOR ART)
FIG. 3 is a circuit diagram showing a structure of a scanning driver 23 and a scanning pulse driver 24.
Figure 4:
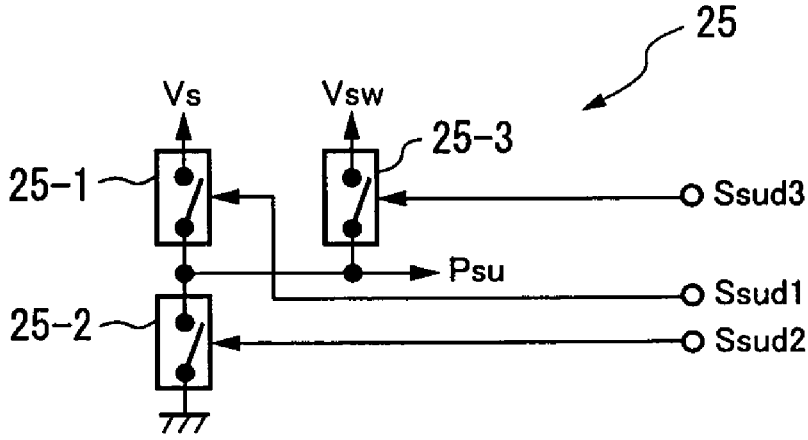
FIG. 4 (PRIOR ART)
FIG. 4 is a circuit diagram showing a structure of a sustaining driver 25.
Figure 5:
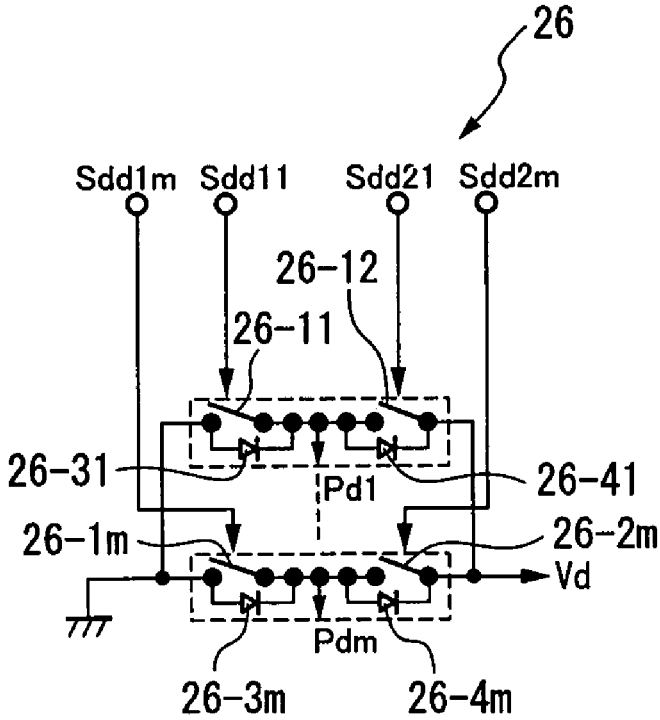
FIG. 5 (PRIOR ART)
FIG. 5 is a circuit diagram showing a structure of a data driver 26.
Figure 6:
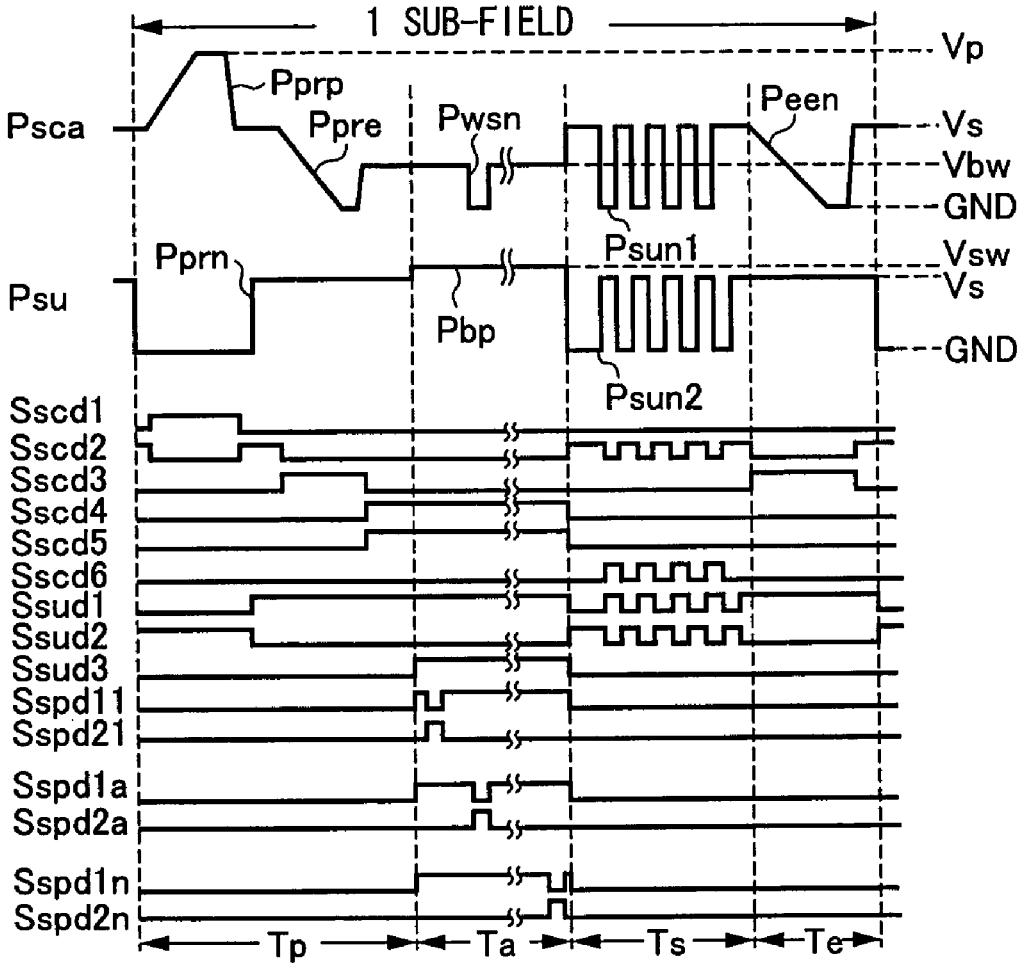
FIG. 6(PRIOR ART)
FIG. 6 is a timing chart showing a write-selective driving operation of the conventional plasma display.
Figure 7:
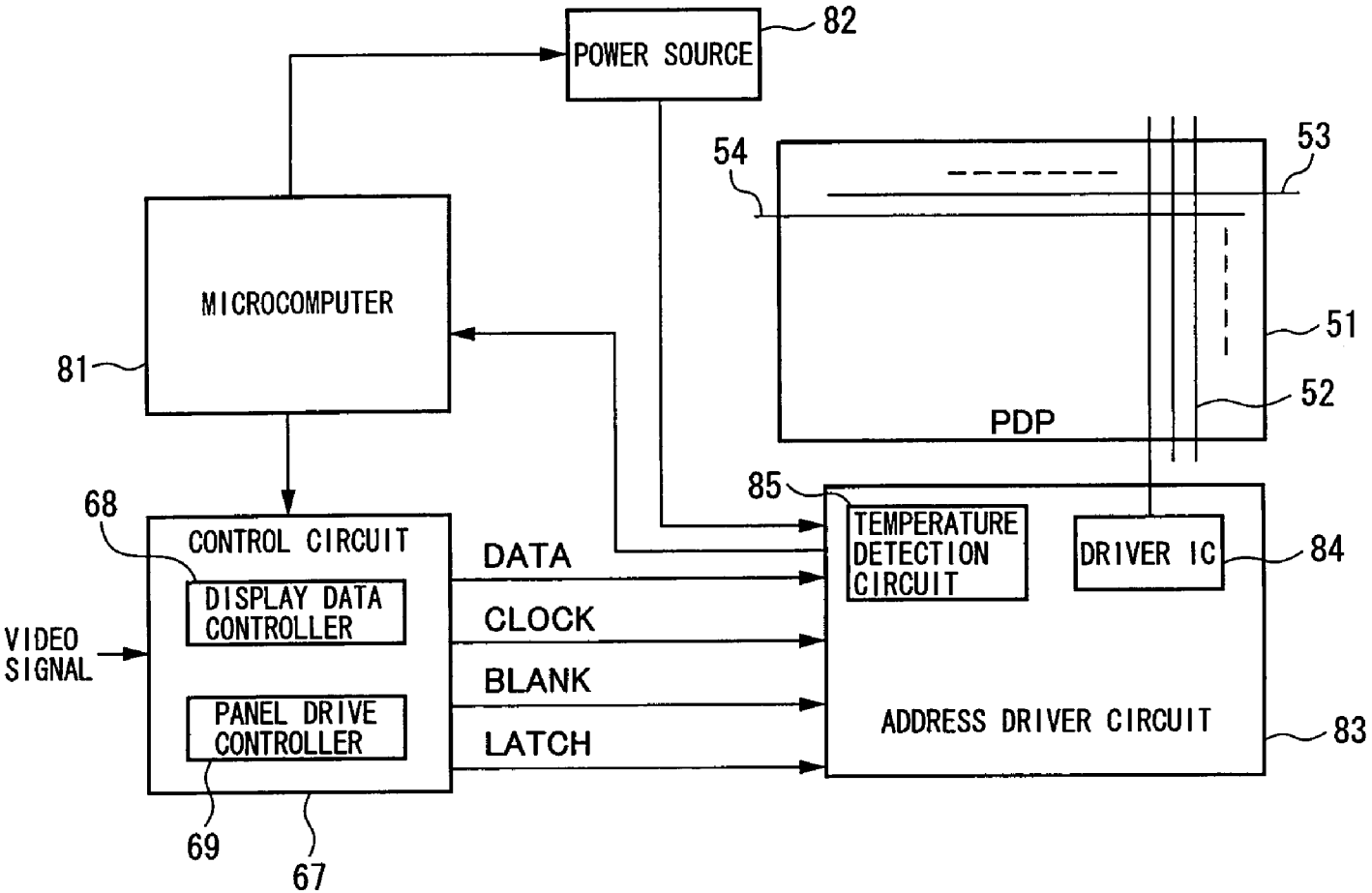
FIG. 7(PRIOR ART)
FIG. 7 is a block diagram showing a display disclosed in Japanese Patent Laid-open No. Hei 11-38930.

In the conventional plasma display shown in FIG. 2, the power source 21 generates the logic voltage Vdd, the data voltage Vd and the sustaining voltage Vs, and the priming voltage Vp and the like are generated by the power source 21 based on the sustaining voltage Vs. On the other hand, in the plasma display shown in FIG. 15, the power source circuit 93 generates the logic voltage Vdd, the data voltage Vd and the sustaining voltage Vs from the alternating voltage 100V, and the power source for driving 21 adopts a configuration that it generates the priming voltage Vp and the like based on the sustaining voltage Vs supplied form the power source circuit 93. Furthermore, the PDP 1, the controller 22, the signal relay board 64, the power source for driving 21, the scanning driver 23, the scanning pulse driver 24, the sustaining driver 25, the data driver 26 and the digital signal processing circuit 92 may be assembled in a module, the control circuit 67 in FIG. 8 may be built in the controller 22, the data HIC 61 to 63 correspond to the data driver 26, and the signal relay board 64 may be provided between the controller 22 and the data driver 26.

What is claimed is:

1. A plasma display, comprising:

a plasma display panel, which includes:

first and second substrates arranged to face each other;

scanning electrodes and common electrodes alternately provided with each other on a side of said first substrate facing said second substrate and extending in a first direction; and data electrodes provided on a side of said second substrate facing said first substrate and extending in a second direction across said first direction;

data drivers which apply data pulse to said data electrodes;

a control circuit which controls operation of said data drivers based on a video signal;

a temperature detector for detecting a temperature around said data drivers and for generating a temperature signal when said temperature exceeds a previously set specified temperature;

a total power detector for detecting a sum of currents supplied from said data drivers to said data electrodes within a time span which is greater than or equal to one sub-field and less than one frame, and for generating a total power control signal when said sum of currents exceeds a predetermined current level;

an individual power detector for detecting an individual current supplied from at least one data driver among said data drivers to said data electrode, and for generating an individual power control signal in response to said temperature signal when said individual current exceeds a predetermined current level; and a protection signal output circuit which outputs a first protection signal to restrain an operation of said data drivers to said control circuit in response to said total power control signal and which outputs a second protection signal to restrain an operation of said at least one data driver to said control circuit in response to said individual power control signal.

2. The plasma display according to claim 1, wherein said control circuit sequentially deletes sub-fields from a least significant bit among sub-fields which compose one frame with an input of said first protection signal as a trigger.

3. The plasma display according to claim 1, wherein said control circuit allows said data drivers to apply equal data pulses to adjacent two scanning electrodes among said scanning electrodes with an input of said first protection signal as a trigger.

4. The plasma display according to claim 1, wherein said protection signal output circuit comprises a microcomputer.

5. A plasma display, comprising:

a plasma display panel, which includes:

first and second substrates arranged to face each other;

scanning electrodes and common electrodes alternately provided with each other on a side of said first substrate facing said second substrate and extending in a first direction; and data electrodes provided on a side of said second substrate facing said first substrate and extending in a second direction across said first direction;

data drivers which apply data pulse to said data electrodes;

a control circuit which controls operation of said data drivers based on a video signal;

a temperature detector for detecting a temperature around said data drivers and for generating a temperature signal when said temperature exceeds a previously set specified temperature;

an individual power detector for detecting an individual current supplied from at least one data driver among said data drivers to said data electrode, and for generating an individual power control signal in response to said temperature signal when said individual current exceeds a predetermined current level; and a protection signal output circuit which outputs a first protection signal and which outputs a second protection signal to restrain an operation of said at least one data driver to said control circuit in response to said individual power control signal.

6. The plasma display according to claim 5, wherein said control circuit sequentially deletes sub-fields from a least significant bit among sub-fields which compose one frame with an input of said second protection signal as a trigger.

7. The plasma display according to claim 5, wherein said control circuit allows said data drivers to apply equal data pulses to adjacent two scanning electrodes among said scanning electrodes with an input of said second protection signal as a trigger.

8. The plasma display according to claim 5, wherein said protection signal output circuit comprises a microcomputer.

9. A method of driving a plasma display including data drivers which apply a data pulse to data electrodes, comprising:

generating a temperature signal when a temperature around said data drivers exceeds a previously set specified temperature;

detecting a sum of currents supplied from said data drivers to said data electrodes within a time span which is greater than or equal to one sub-field and less than one frame;

generating a total power control signal when said sum of currents exceeds a predetermined current level;

detecting an individual current supplied from at least one data driver among said data drivers to said data electrode;

generating an individual current control signal in response to said temperature signal when said individual current exceeds a predetermined current level;

restraining an operation of said data drivers in response to said total power control signal; and restraining an operation of said at least one data driver in response to said individual current control signal.

10. The method of driving a plasma display according to claim 9, wherein said restraining the operation of said drivers further comprises deleting sub-fields sequentially from a least significant bit among sub-fields that compose one frame.

11. The method of driving a plasma display according to claim 9, wherein said restraining the operation of said one data driver further comprises applying equal data pulses to adjacent two scanning electrodes.

12. A method of driving a plasma display including data drivers which apply a data pulse to data electrodes, comprising:

generating a temperature signal when a temperature around said data drivers exceeds a previously set specified temperature;

detecting an individual current supplied from at least one data driver among said data drivers to said data electrode;

generating an individual current control signal in response to said temperature signal when said individual current exceeds a predetermined current level; and restraining an operation of said at least one data driver in response to said individual current control signal;

wherein said restraining the operation of said drivers further comprises deleting sub-fields sequentially from a least significant bit among sub-fields that compose one frame.

* * * * *